US008678692B2

(12) United States Patent
Yoon

(10) Patent No.: US 8,678,692 B2
(45) Date of Patent: Mar. 25, 2014

(54) DOUBLE-ENDED MAKEUP BRUSH TOOL HAVING AUTOMATIC SEALING STRUCTURE

(75) Inventor: Hyun-Son Yoon, Incheon (KR)

(73) Assignee: Morris Corporation, Incheon-shi (KR)

( * ) Notice: Subject to any disclaimer, the term of this patent is extended or adjusted under 35 U.S.C. 154(b) by 597 days.

(21) Appl. No.: 12/980,066

(22) Filed: Dec. 28, 2010

(65) Prior Publication Data

US 2012/0148330 A1 Jun. 14, 2012

(30) Foreign Application Priority Data

Dec. 14, 2010 (KR) ..... 10-2010-0127472

(51) Int. Cl.
*B43K 5/16* (2006.01)

(52) U.S. Cl.
USPC ..... 401/108; 401/17; 401/29

(58) Field of Classification Search
USPC ..... 401/29–33.107, 108, 17–19
See application file for complete search history.

(56) References Cited

U.S. PATENT DOCUMENTS

| | | | | |
|---|---|---|---|---|
| 3,525,573 | A * | 8/1970 | Fend | 401/108 |
| 3,985,455 | A * | 10/1976 | Wahlberg | 401/30 |
| 6,290,413 | B1 * | 9/2001 | Wang | 401/30 |
| 7,334,954 | B1 * | 2/2008 | Rentz | 401/202 |
| 7,390,137 | B1 * | 6/2008 | Rentz | 401/112 |

FOREIGN PATENT DOCUMENTS

KR 1020070024048 3/2007

* cited by examiner

*Primary Examiner* — David Walczak
(74) *Attorney, Agent, or Firm* — Intellectual Property Law Group LLP

(57) ABSTRACT

A double-ended makeup brush tool having an automatic sealing structure, in which respective brushes provided in opposite ends of a barrel can be selectively and alternately used, so that, when one brush is used, the other brush can be disinfected by a disinfectant inside the barrel, thereby being kept clean. When a user presses the rear end of the cartridge with the finger, the locking protrusion of the cartridge is removed from a rear locking hole of the barrel and is caught by a front locking hole and, in the above state, the brush hole of the barrel is opened by an anti-drying unit and a first brush can be ejected from the barrel through the open brush hole. When the locking protrusion is removed from the front locking hole and is caught by the rear locking hole, the first brush can be retracted into the barrel and the anti-drying unit closes the brush hole.

11 Claims, 17 Drawing Sheets

Prior Art

Prior Art

DOUBLE-ENDED MAKEUP BRUSH TOOL HAVING AUTOMATIC SEALING STRUCTURE

PRIORITY

This application claims priority under 35 U.S.C. §119(a) to an application filed in the Korean Intellectual Property Office on Dec. 14, 2010 and assigned Korean Patent Application No. 10-2010-0127472, the contents of which are incorporated herein by reference.

BACKGROUND OF THE INVENTION

1. Field of the Invention

The present invention relates, in general, to a double-ended makeup brush tools having an automatic sealing structure and, more particularly, to a double-ended makeup brush tool having an automatic sealing structure, in which, when a barrel is opened, a makeup brush can be ejected outside the barrel and, when the brush is retracted into the barrel, the brush can be disinfected by a disinfectant charged in a sealed cartridge.

2. Description of the Related Art

Makeup brushes are used almost daily and come into contact with the skin of users, such as on the faces of the users, so that it is very important to keep the makeup brushes clean.

To keep a makeup brush clean, the makeup brush must be isolated from the atmosphere when it is not being used and the brush must also be disinfected. However, most conventional makeup brush tools do not have a structure capable of isolating the brush from the atmosphere or disinfecting the brush.

In the related art, Korean Patent No. 10-0834449 proposed a makeup brush tool shown in FIG. 1 of the accompanying drawings. This makeup brush tool uses a cap for preventing the brush from being exposed to the atmosphere, a protective tube moving in a direction towards the makeup brush prior to covering the brush with the cap and thereby preventing brush bristles from being folded or broken by the cap, and a spring-biased trigger unit for elastically and automatically advancing the protective tube by one-touch manipulation of a user.

However, the above-mentioned makeup brush tool is problematic in that it is impossible to completely seal a barrel, thus failing to keep the brush inside the barrel clean and failing to disinfect the brush inside the barrel.

Another example of conventional makeup brush tools is referred to by Japanese Utility Model Registration No. 3096225 disclosing a knock-type makeup brush tool shown in FIG. 2 of the accompanying drawings. This knock-type makeup brush tool uses a cap and a knock button, so that a makeup brush can be retractably ejected from a barrel by operation of the knock button and the barrel can be sealed by the cap. However, this knock-type makeup brush tool is problematic in that a user must manually open or close the cap.

SUMMARY OF THE INVENTION

Accordingly, the present invention has been made keeping in mind the above problems occurring in the related art, and the present invention is intended to propose a double-ended makeup brush tool having an automatic sealing structure, in which a brush can be retractably ejected from a barrel by a sliding motion of a cartridge and can realize noncontact sealing of the barrel by an anti-drying unit.

Further, the intent of the present invention is to propose a double-ended makeup brush tool having an automatic sealing structure, in which the cartridge is charged with a volatile disinfectant and, when the brush is kept in the sealed barrel, the brush can be disinfected by the vapor produced by the disinfectant as it volatilizes being charged in the cartridge.

Further, another intent of the present invention is to propose a double-ended makeup brush tool having an automatic sealing structure, in which opposite ends of the barrel are provided with respective brushes.

In order to achieve the above objects, according to one aspect of the present invention, there is provided a double-ended makeup brush tool having an automatic sealing structure comprising: a barrel shaped in a form of an integrated tubular casing, with a brush hole formed through a conical front end of the barrel so as to allow a retractable ejection of a first brush therethrough, and with an insert hole formed through a rear end of the barrel; a cartridge sealed at opposite ends thereof both by the first brush attached to a front end and by a second brush attached to a rear end, the cartridge being inserted into the barrel such that the cartridge can be axially moved forwards and backwards inside the barrel; and an anti-drying unit interposed between the cartridge and the barrel such that the anti-drying unit can air-tightly seal the brush hole of the barrel in response to axial movement of the cartridge.

The barrel may be provided with a first locking hole and a second locking hole sequentially formed in the barrel at respective locations spaced apart from each other in an axial direction from the rear end of the barrel, and the cartridge may be provided with a locking protrusion protruding from a sidewall of a filter receiving part defined in the rear end of the cartridge such that the locking protrusion can be removably caught by the first locking hole or by the second locking hole.

The locking protrusion may be formed on a sidewall of the cartridge in the form of an elastic free end such that the locking protrusion can be easily and removably caught by the first locking hole or by the second locking hole.

The barrel may further comprise: a return switch formed on the barrel in a form of a free end at a location in front of the first locking hole and allowing the locking protrusion to be easily removed from the first locking hole, so that, when the return switch is pressed, the return switch is bent into the barrel and renders the locking protrusion, which was caught in the first locking hole, to be bent into the cartridge and thereby to be displaced from the first locking hole.

The return switch may have a protruding push part so that the return switch can be easily pushed.

The cartridge may be provided with a free end-shaped guide protrusion at a location opposite the locking protrusion, and the barrel may be provided with a guide slot at a location corresponding to the guide protrusion for receiving the guide protrusion therein, thus guiding rectilinear movement of the guide protrusion as the cartridge moves axially inside the barrel.

The cartridge may be provided with a recess for defining a space allowing the free end of the locking protrusion to be bent into the space.

The cartridge may comprise: a filter receiving part for receiving a filter therein, the filter receiving part having a predetermined diameter, with a locking protrusion formed in the filter receiving part at a location near a rear end of the filter receiving part; a cone holding part extending from the rear end of the filter receiving part and having a diameter smaller than that of the filter receiving part, and holding the second brush therein; a connection part extending from a front end of the filter receiving part and having a diameter smaller than that of the filter receiving part, and receiving an extension part of the filter received in the filter receiving part; an extension part extending from the connection part and having a diameter smaller than that of the connection part, and holding the first brush in a front end thereof; and a brush holding part provided in the front end of the extension part and securely holding the first brush.

The cartridge may further comprise: a hollow cone received in the cone holding part, with the second brush held in the hollow cone in such a way that a disinfectant impregnated in the filter received in the filter receiving part can be supplied to the second brush.

The double-ended makeup brush tool may further comprise: a conical cap for covering the second brush, the conical cap having internal threads engaging with external threads of the cone holding part.

The locking protrusion may be formed in a curved plate, which is seated in a recess formed in a sidewall of the sealed filter receiving part to a predetermined depth and has a shape corresponding to the recess, wherein either the curved plate or the recess has a pair of supports such that the curved plate can be seated in the recess while defining a parallel space between them and allowing outer surfaces of the curved plate and the filter receiving part to make contact with each other without a step being formed between them.

As described above, the double-ended makeup brush tool having the automatic sealing structure according to the present invention is advantageous in that the brushes provided in the opposite ends of the barrel can be selectively and alternately used, so that, when one brush is used, the other brush can be disinfected and kept cleaned by the disinfectant inside the sealed barrel.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Herein below, a double-ended makeup brush tool having an automatic sealing structure according to an embodiment of the present invention will be described in detail with reference to the accompanying drawings.

Figure 1:
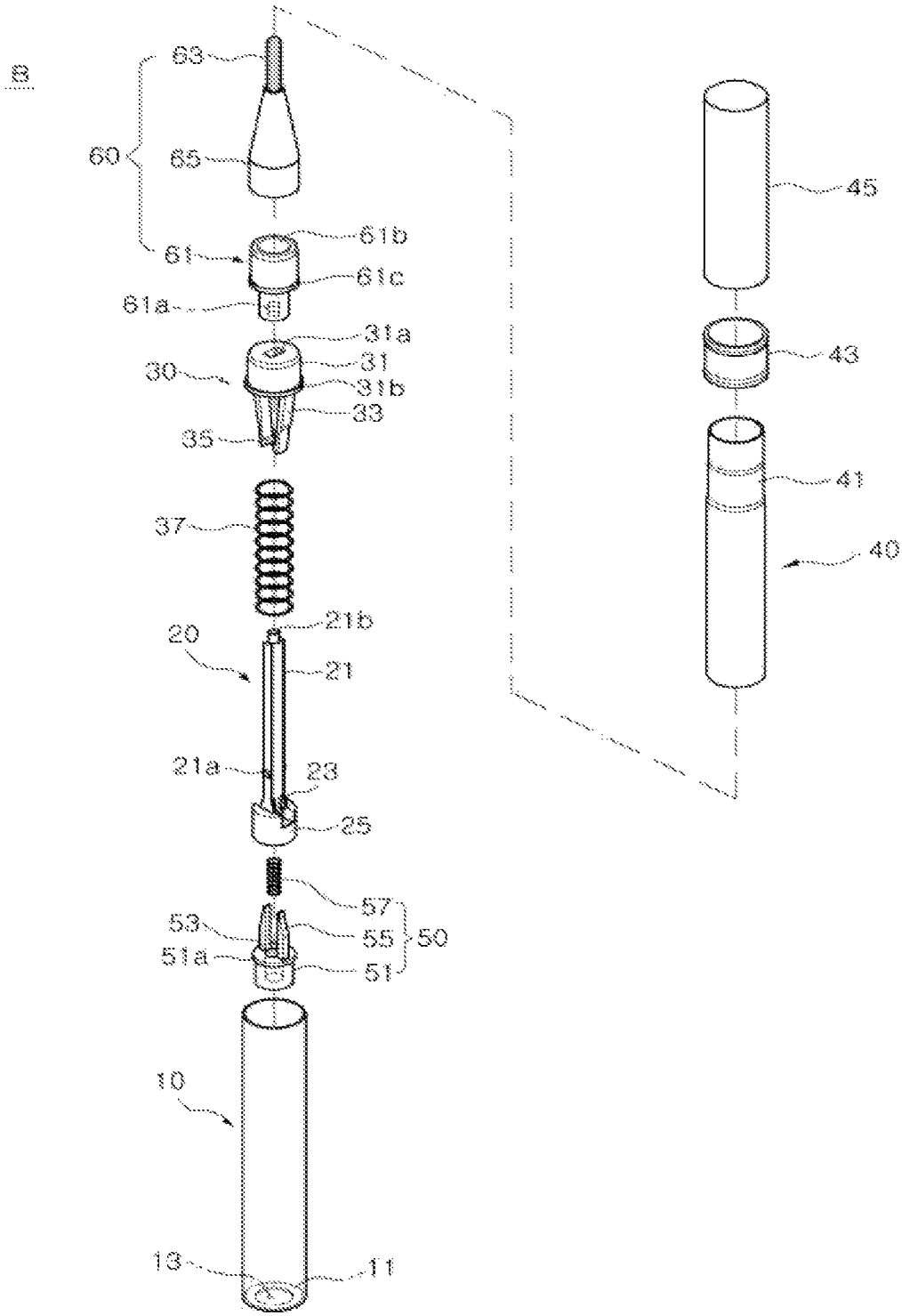
FIGS. 1 and 2 are exploded perspective views illustrating examples of conventional makeup brush tools.
Figure 2:
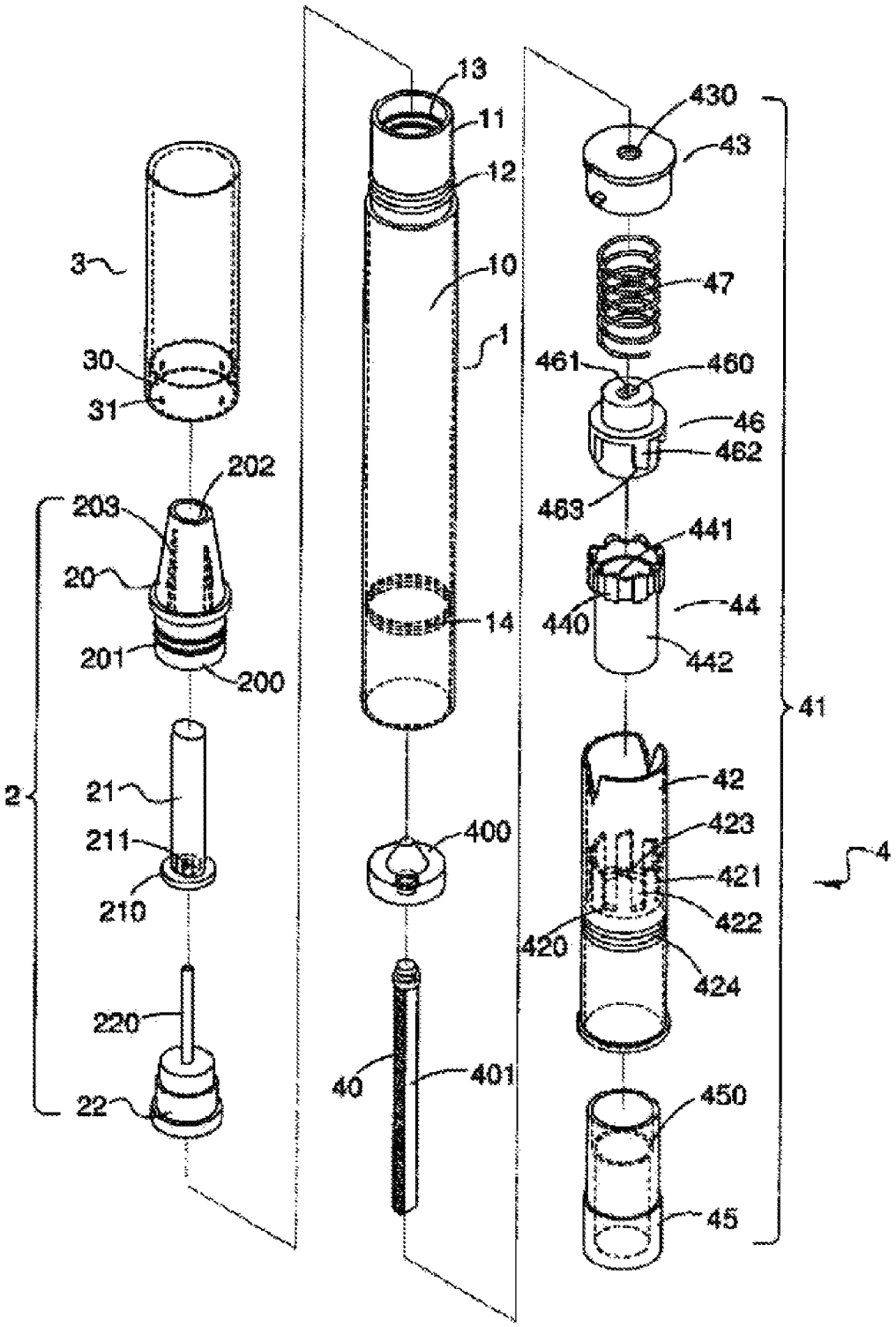
Figure 3:
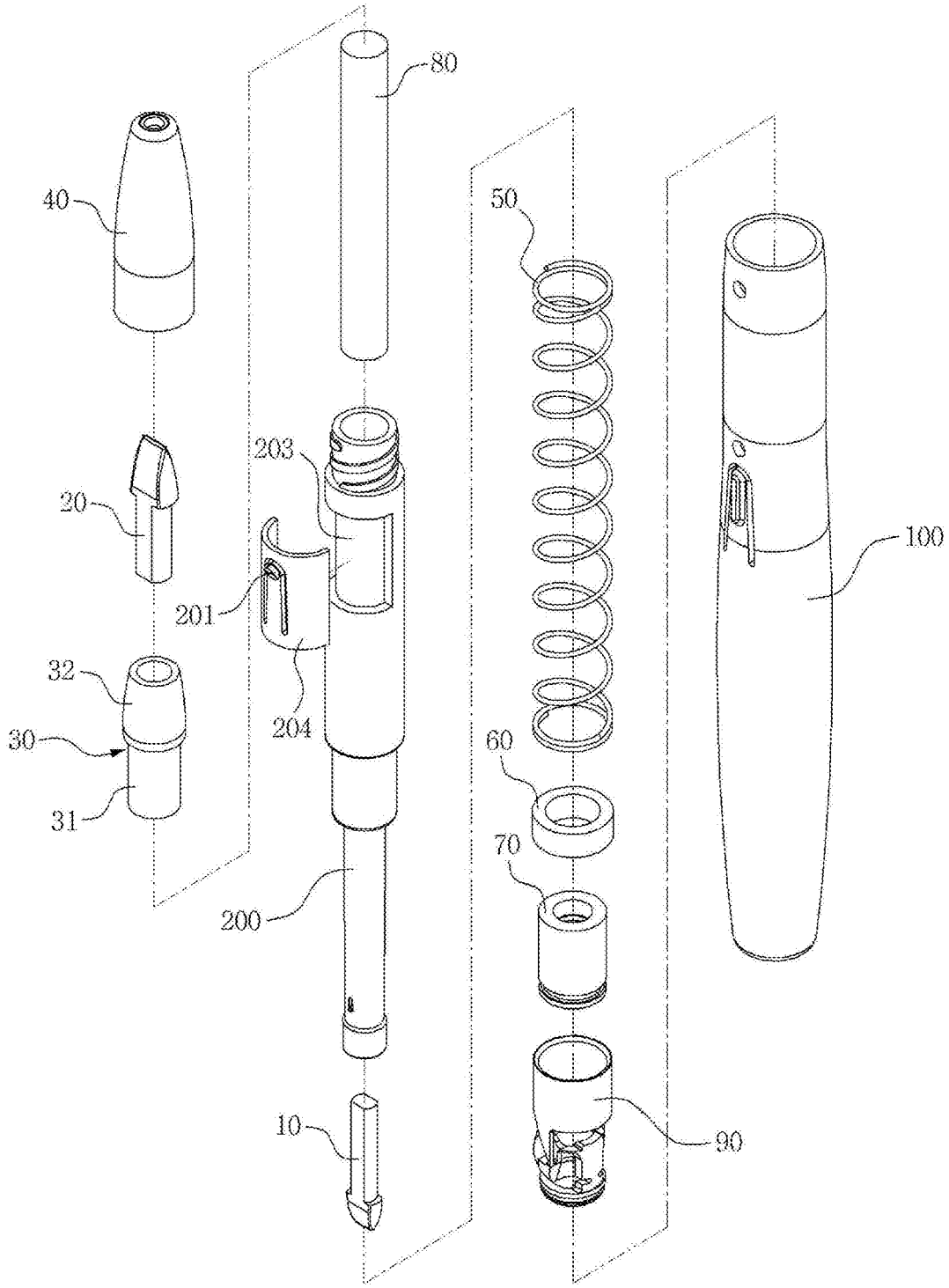
FIG. 3 is an exploded perspective view illustrating a double-ended makeup brush tool having an automatic sealing structure according to an embodiment of the present invention.
Figure 4:
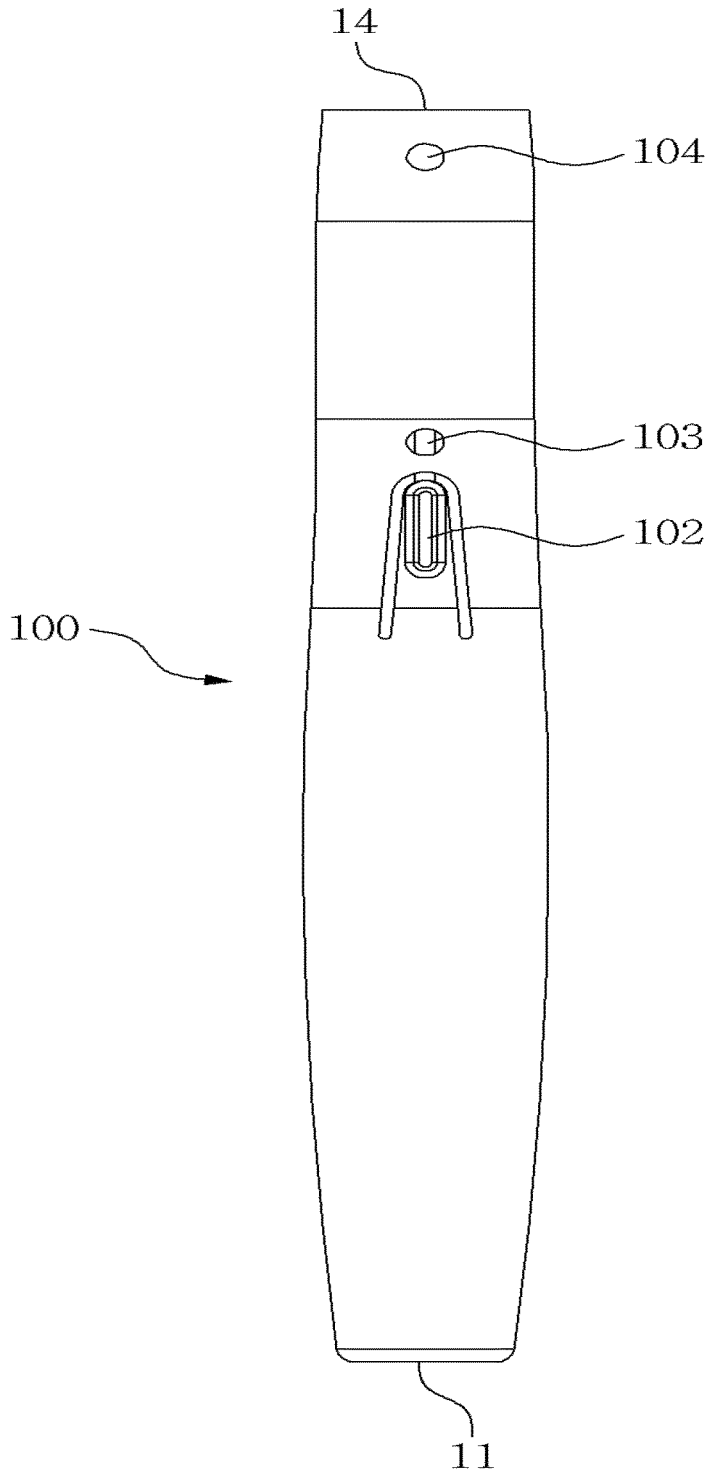
FIG. 4 is a front view of a barrel shown in FIG. 3.
Figure 5:
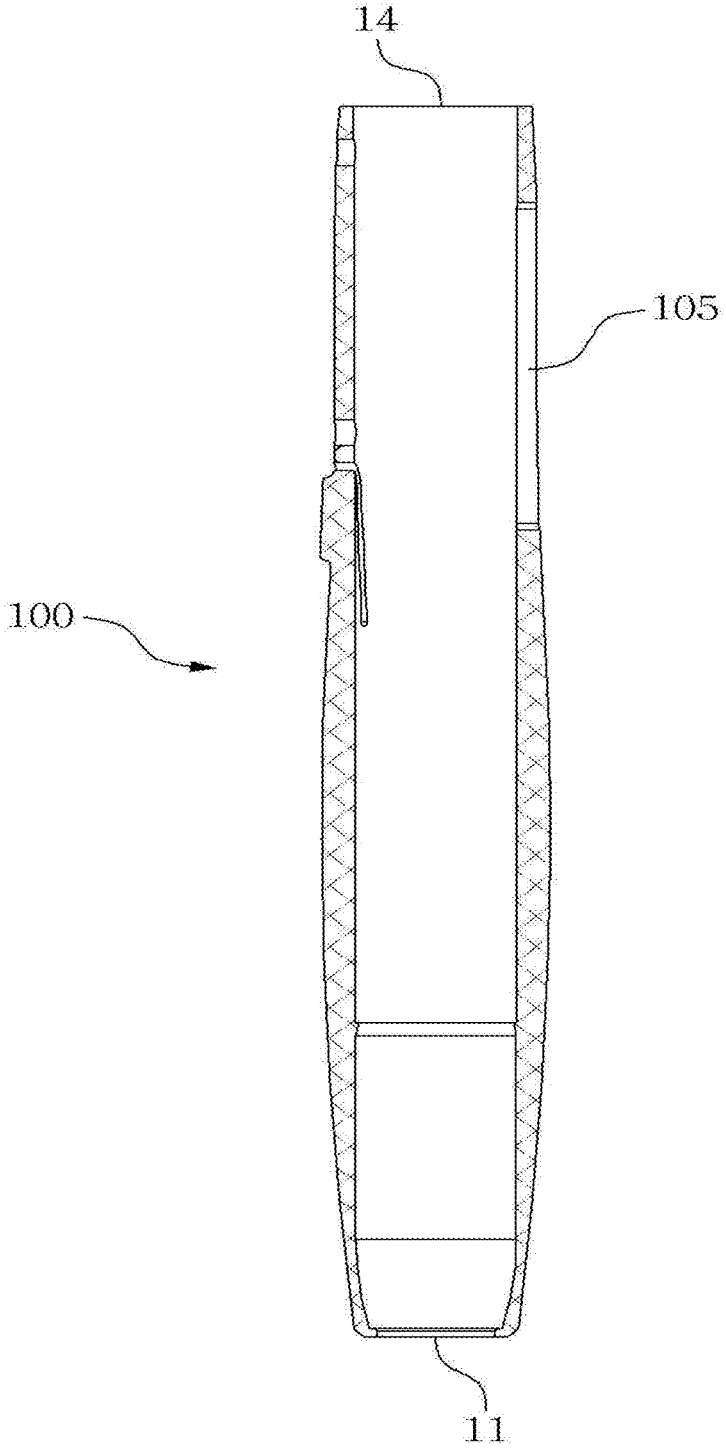
FIG. 5 is a sectional view of the barrel.

FIG. 3 is an exploded perspective view illustrating a double-ended makeup brush tool having an automatic sealing structure according to an embodiment of the present invention. FIGS. 4 and 5 are a front view and a sectional view of a barrel shown in FIG. 3.

Figure 6:
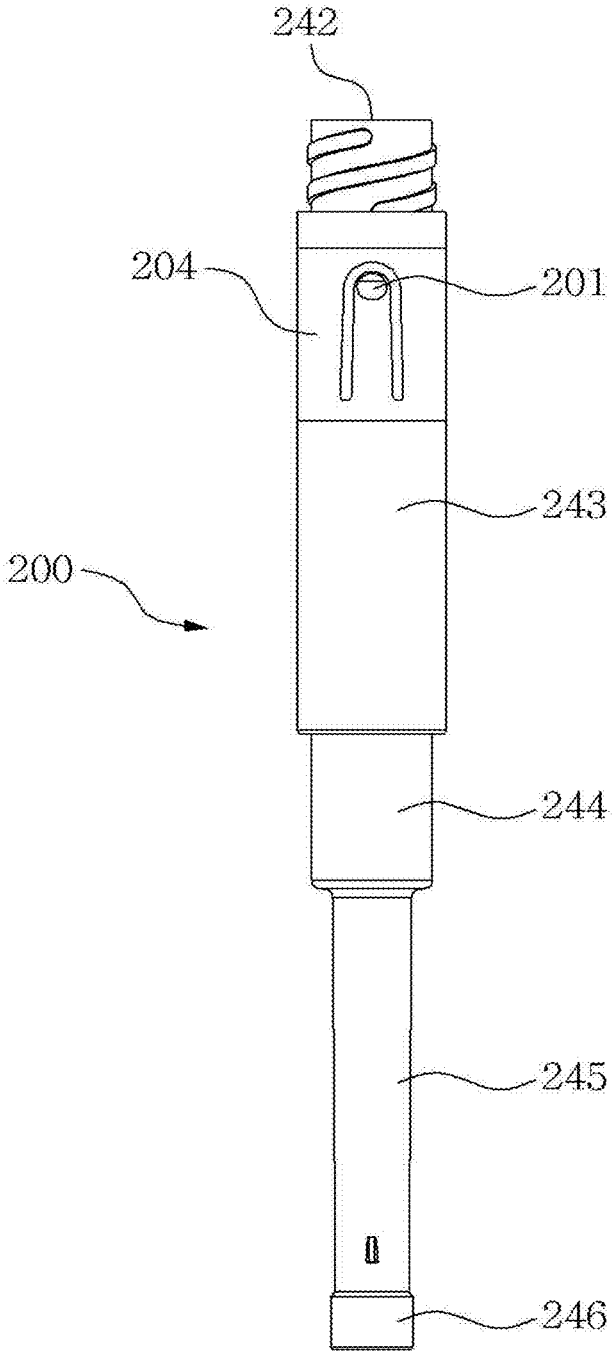
FIG. 6 is a front view of a cartridge shown in FIG. 3.
Figure 7:
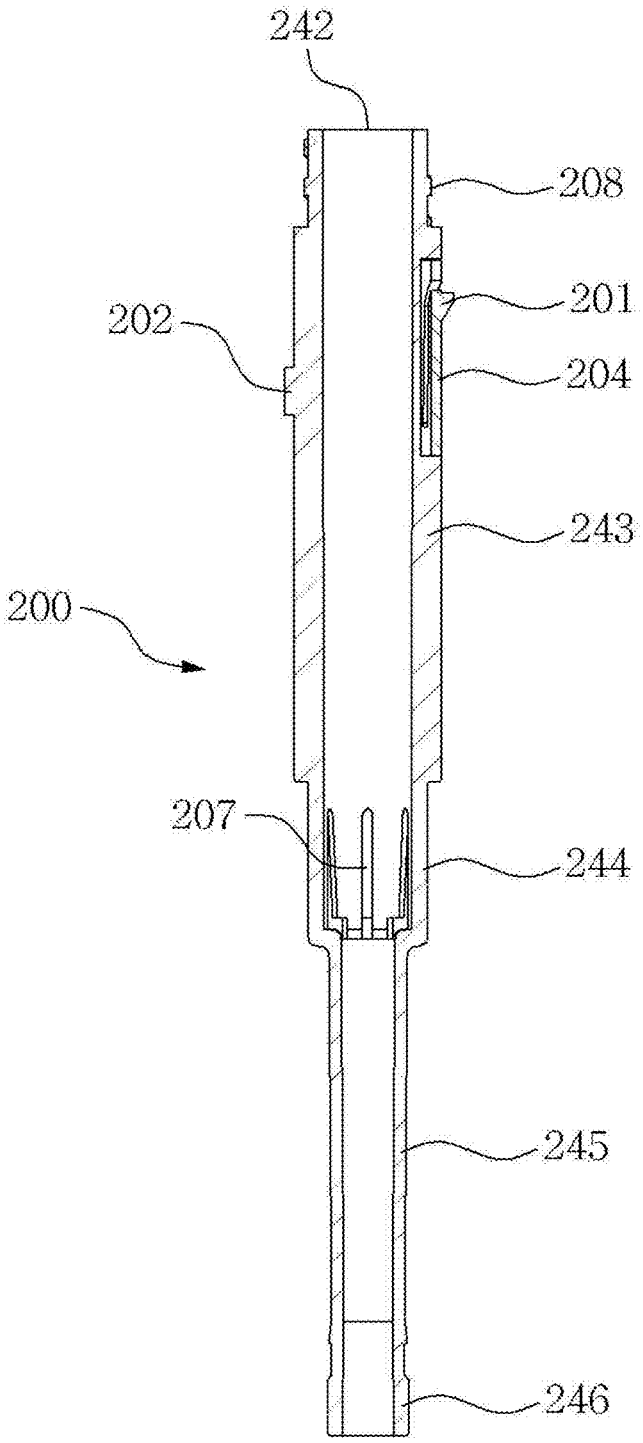
FIG. 7 is a sectional view of the cartridge.
Figure 8:
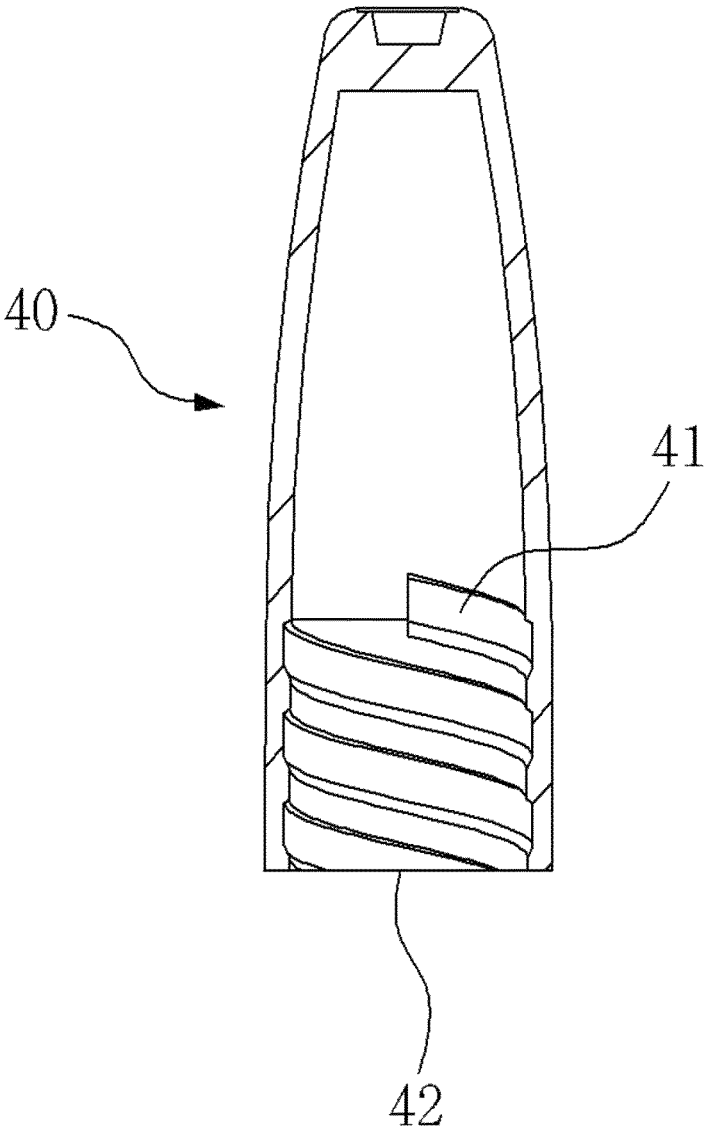
FIG. 8 is a sectional view of a cap shown in FIG. 3.

Further, FIGS. 6 and 7 are a front view and a sectional view of a cartridge shown in FIG. 3. FIG. 8 is a sectional view of a cap shown in FIG. 3.

Figure 9A:
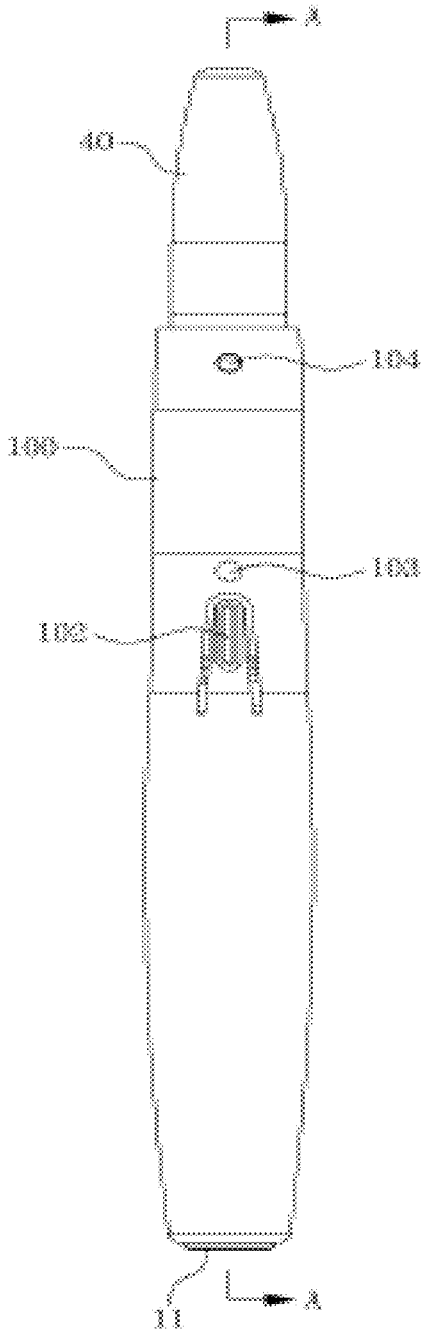
FIG. 9A is a front view illustrating the assembled double-ended makeup brush tool of FIG. 3 in a closed state.
Figure 9B:
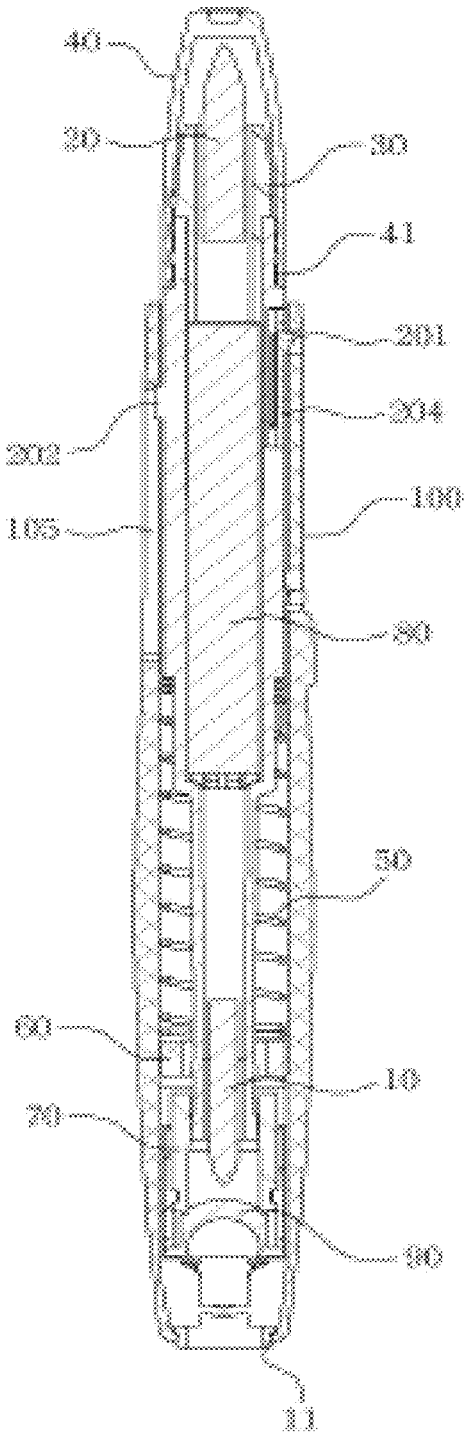
FIG. 9B is a sectional view of the assembled double-ended makeup brush tool taken along line A-A of FIG. 9A.
Figure 10A:
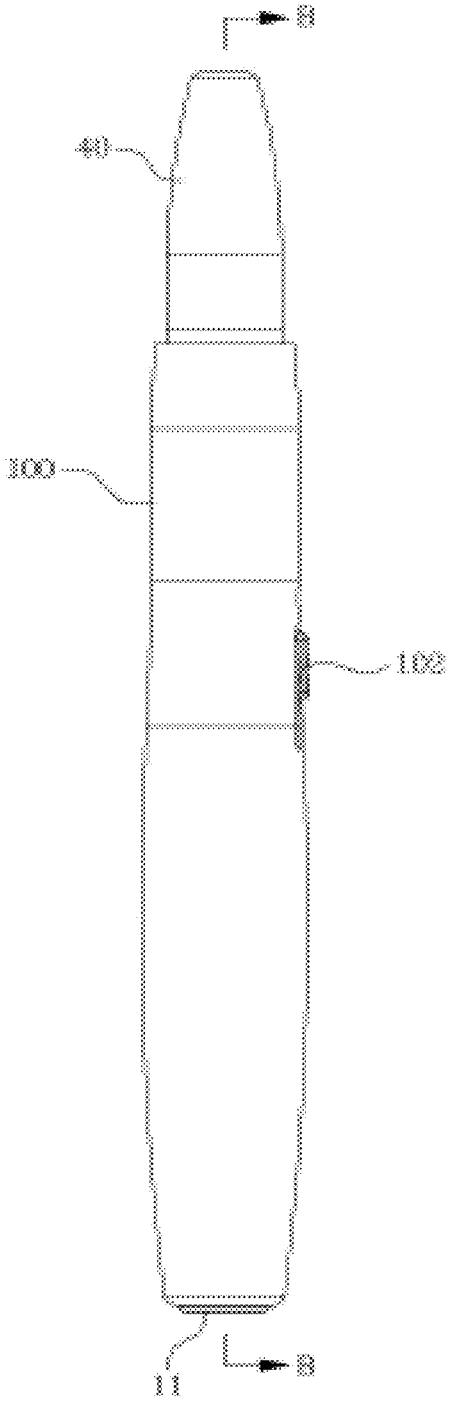
FIG. 10A is a side view illustrating the assembled double-ended makeup brush tool of FIG. 3 in the closed state.
Figure 10B:
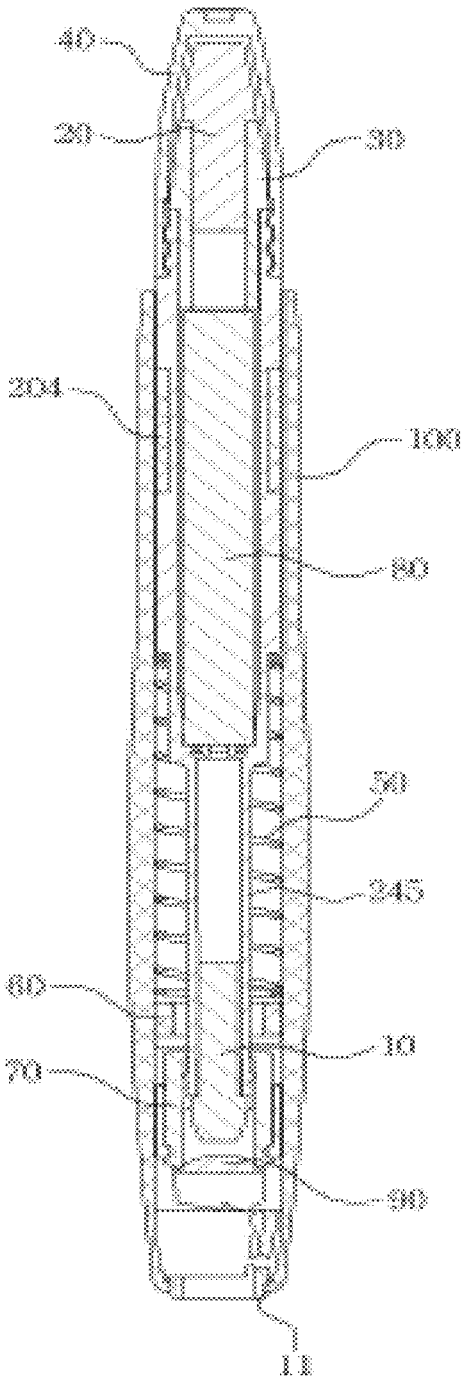
FIG. 10B is a sectional view of the assembled double-ended makeup brush tool taken along line B-B of FIG. 10A.
Figure 11:
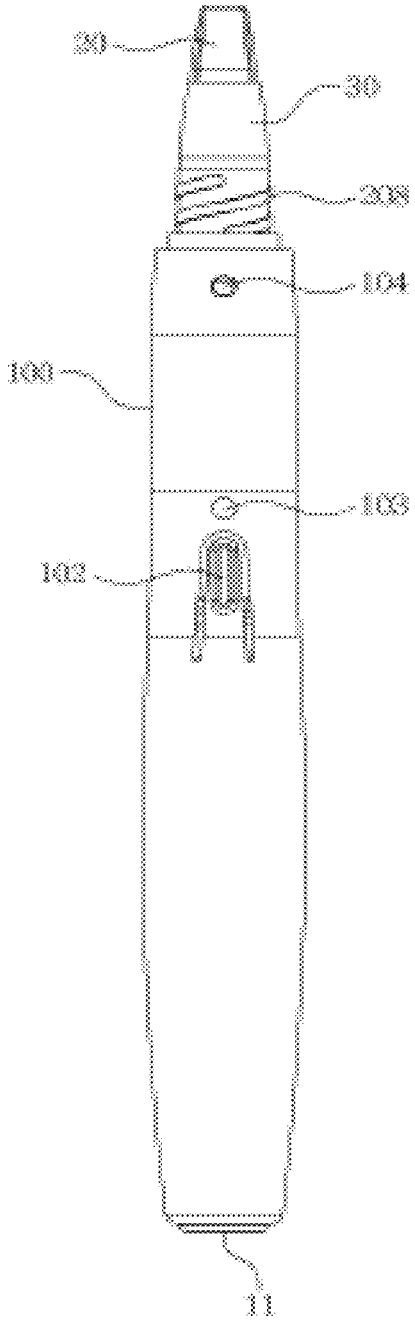
FIG. 11 is a front view of the assembled double-ended makeup brush tool of FIG. 10A, from which a cap is removed.

Further, FIGS. 9A and 10A are a front view and a side view of the assembled double-ended makeup brush tool of FIG. 3 in a closed state. FIGS. 9B and 10B are sectional views of the assembled double-ended makeup brush tool taken along lines A-A and B-B of FIGS. 9A and 10A, respectively. FIG. 11 is a front view of the assembled double-ended makeup brush tool of FIG. 10A, from which a cap has been removed.

Figure 12A:
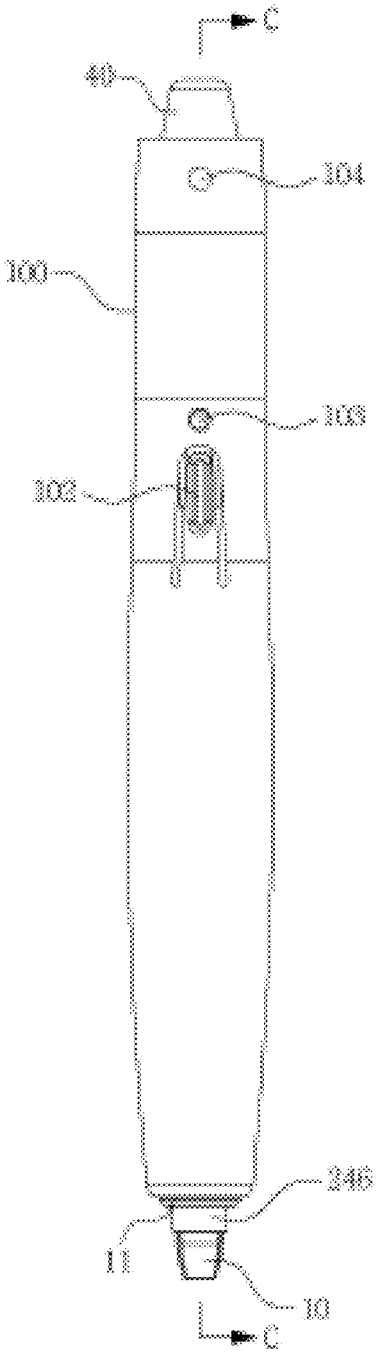
FIG. 12A is a front view illustrating the assembled double-ended makeup brush tool of FIG. 3 in an opened state.
Figure 12B:
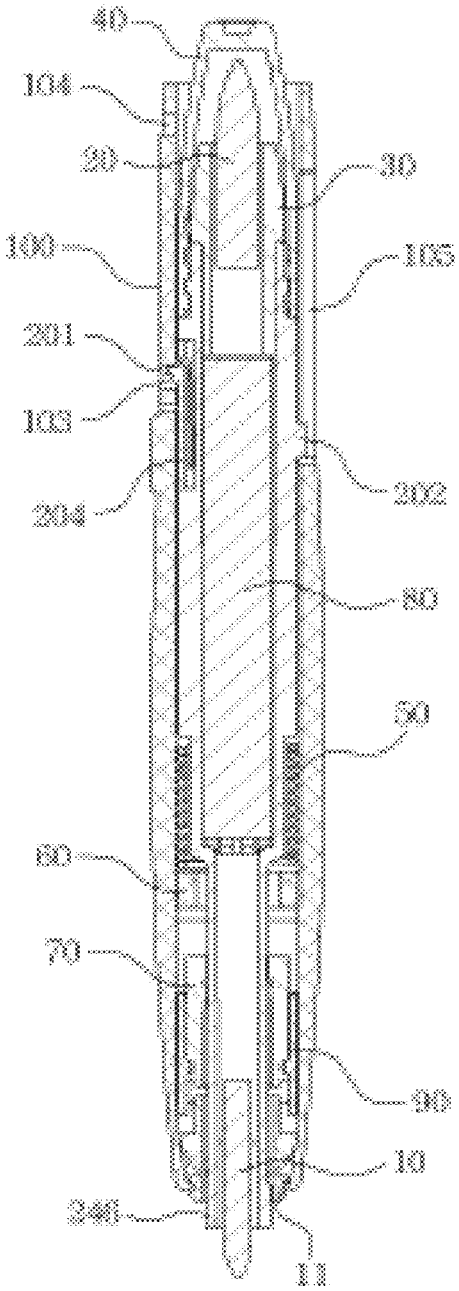
FIG. 12B is a sectional view of the assembled double-ended makeup brush tool taken along line C-C of FIG. 12A.
Figure 13A:
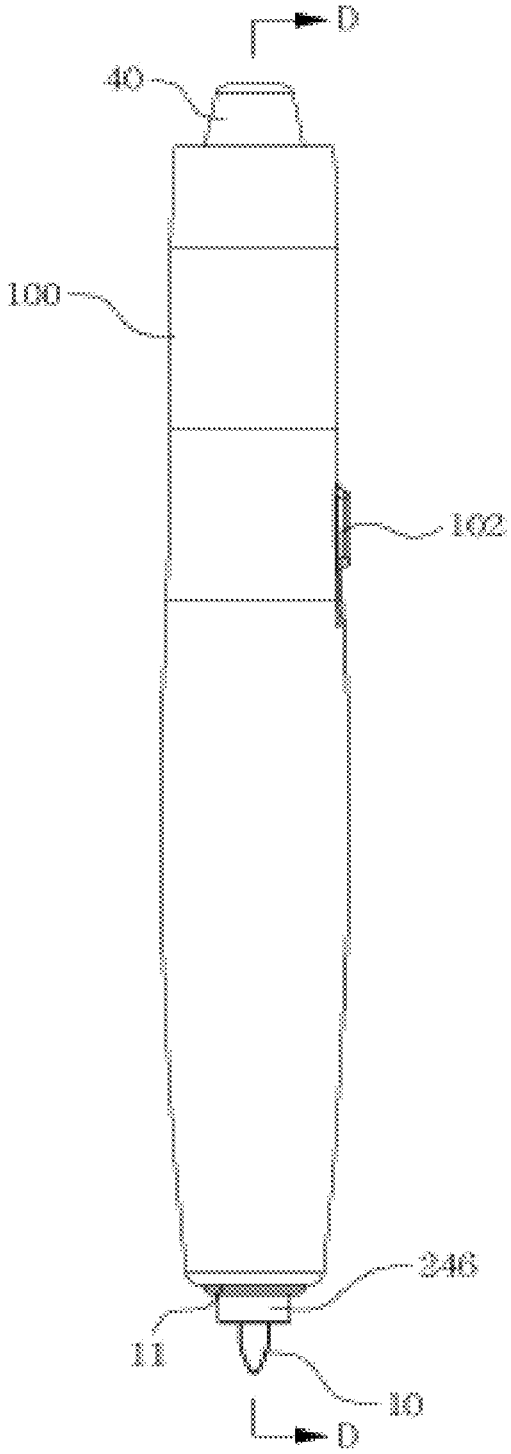
FIG. 13A is a side view illustrating the assembled double-ended makeup brush tool of FIG. 3 in the opened state.
Figure 13B:
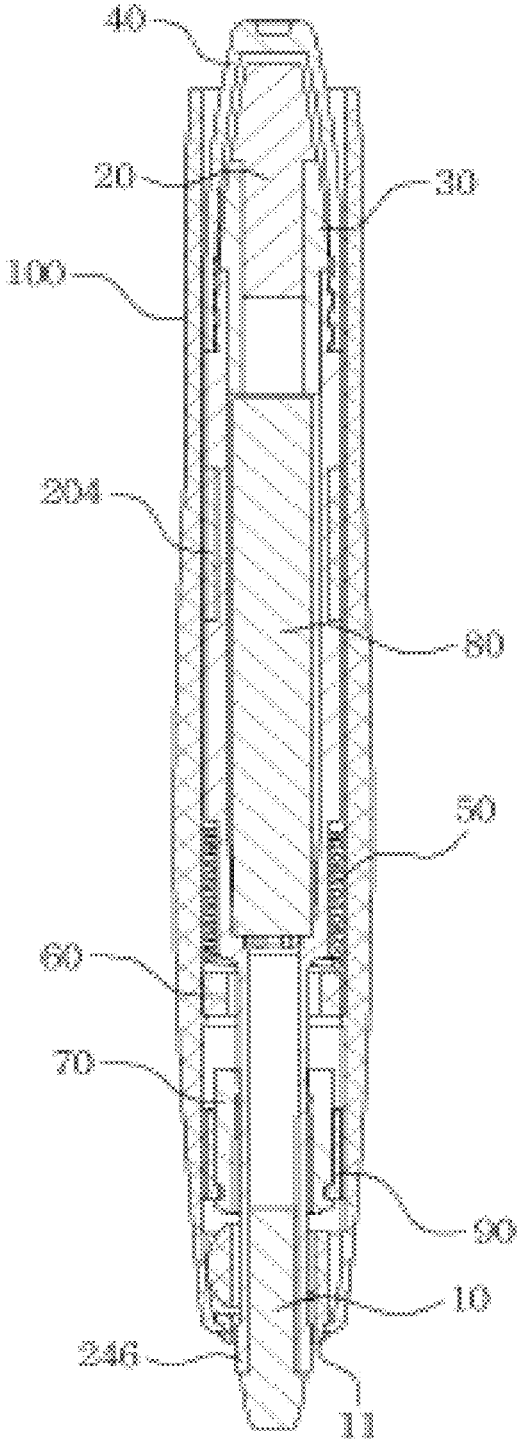
FIG. 13B is a sectional view of the assembled double-ended makeup brush tool taken along line D-D of FIG. 13A.

Further, FIGS. 12A and 13A are a front view and a side view of the assembled double-ended makeup brush tool of FIG. 3 in an opened state. FIGS. 12B and 13B are sectional views of the assembled double-ended makeup brush tool taken along lines C-C and D-D of FIGS. 12A and 13A, respectively.

As shown in FIG. 3, a double-ended makeup brush tool according to the present invention includes a barrel 100, a cartridge 200, a first brush 10, a second brush 20, a cap 40, a filter 80, and an anti-drying unit provided in the barrel 100 for air-tightly closing a brush hole of the barrel.

The anti-drying unit includes a spring 50, an O-ring 60, a packing 70 and an openable door module 90. The construction and function of the anti-drying unit according to the present invention remain almost the same as those of an anti-drying unit, which was disclosed in Korean Unexamined Patent Publication No. 10-2008-0074269 filed by the inventor of the present invention and entitled "a retractable writing instrument having an anti-drying unit". Both use the anti-drying unit for air-tightly closing a nozzle of a barrel. The detailed description of the construction and function of the anti-drying unit will be omitted from the following description.

In the present invention, the anti-drying unit includes the spring 50 for elastically biasing the cartridge to its original position inside the barrel 100, the O-ring 60 installed inside the barrel 100 so as to seal the gap between the barrel and the cartridge while allowing axial movement of the cartridge inside the barrel, and the packing 70 seated in the barrel 100 at a location between the O-ring 60 and the brush hole 11 of the barrel 100. The anti-drying unit further includes the openable door module 90, which includes both a holder air-tightly combined with the O-ring 60 and a ball-type door coming into close surface contact with the brush hole, and opens or closes the brush hole by rotating the ball-type door.

When a user presses a screw lever functioning as a push member of the makeup brush tool with the thumb while holding the barrel 100 with one hand, the openable door module 90 of the anti-drying unit is operated in conjunction with movement of both the screw lever and the cartridge in such a way that the ball-type door can be rotated by an angle of 90° in an opening direction and thereby a passage of the ball-type door becomes aligned with the axis of the barrel 100, thus opening the brush hole 11 of the barrel 100.

Therefore, the brush can be ejected from the barrel 100 through the brush hole after passing through the open passage of the openable door module 90, allowing the user to use the brush.

When the user pushes the return switch, the cartridge is released by the return switch from the locked state relative to the barrel, so that the restoring force of the spring 50 can elastically return the cartridge to the original position. Therefore, the brush is retracted into the barrel 100 and the ball-type door of the openable door module 90 in the above state is rotated by an angle of 90° in a closing direction such that the passage of the ball-type door is located perpendicular to the axis of the barrel, thus closing the brush hole 11 of the barrel 100.

Here, for the sake of description, the end of the barrel having the retractable first brush will be referred to as a front end of the barrel and the opposite end having the fixed and capped second brush will be referred to as a rear end.

Further, the direction in which the first brush moves to be ejected from the barrel will be referred to as an advancing direction or a forward direction and the opposite direction in which the first brush moves to be retracted into the barrel will be referred to as a retracting direction or a backward direction.

As shown in FIGS. 4 and 5, the barrel 100 is shaped in the form of an integrated casing having a tubular structure.

The barrel 100 may be produced by a molding process, such as a plastic injection molding process. When the barrel 100 is produced by the injection molding process using a plastic material, the barrel 100 may have at least one of elasticity, flexibility and extendibility, which are the principal characteristics of the plastic material.

The barrel 100 has a brush hole 11 in the conical front end and an insert hole 14 in the rear end. The insert hole 14 has a substantial inner diameter, which can allow the following elements to be installed in the barrel through the insert hole 14.

In the barrel 100, a second locking hole 104, a first locking hole 103 and a return switch 102 are sequentially formed in the sidewall at respective locations spaced apart from each other in succession from the rear end.

The first locking hole 103 and the second locking hole 104 are formed such that a locking protrusion of the cartridge can be removably caught thereby when the cartridge is moving inside the barrel in an axial direction.

Described in detail, the second locking hole 104 is formed at a location near the rear end of the barrel 100 such that, when the cartridge has been fully retracted into the barrel 100, the locking protrusion can be removably caught by the second locking hole 104. The first locking hole 103 is formed in the barrel 100 at a location in which the locking protrusion can be removably caught by the first locking hole 103 when the cartridge has fully advanced in the barrel 100. The respective locations of the first and second locking holes 103 and 104 are axially aligned with each other on the barrel and are spaced apart from each other by a predetermined distance, within which the cartridge moves.

The return switch 102 is shaped in the form of a free end, which is provided on the barrel at a location in front of the first locking hole 103.

The return switch 102 has elasticity such that the switch 102 can be elastically bent inwards into the sidewall of the barrel 100. Thus, when the user presses the return switch 102 with the finger, the return switch 102 can be elastically bent into the barrel 100 and the free end of the locking protrusion can be removed from the first locking hole 103.

Thus, it is preferable that the return switch 102 has a protruding push part on its outer surface so that the return switch 102 can be more easily pushed.

A guide slot 105 is formed through the sidewall of the barrel at a location diametrically opposite to the return switch 102 and the locking holes 103 and 104.

The guide slot 105 guides axial movement of the cartridge inside the barrel within the stroke between the two locking holes 103 and 104, by which the guide protrusion may be removably caught as will be described later herein.

The guide slot 105 is a longitudinal slot, which is formed through the sidewall of the barrel 100 in an axial direction.

As shown in FIGS. 6 and 7, the cartridge 200 is an integrated body comprising several parts having different diameters, which sequentially reduce as it goes from a rear end hole 242. That is, the cartridge 200 has a filter receiving part 243, a connection part 244 having a diameter smaller than that of the filter receiving part 243, an extension part 245 having a diameter smaller than that of the connection part 244, and a brush holding part 246 provided in the front end of the extension part 245 for holding the brush.

The cartridge 200 is inserted into the barrel 100 through the cartridge insert hole 14 and can axially reciprocate inside the barrel 100 within a limited stroke in response to a manipulation of a user such that the brush can be retractably ejected from the barrel 100 through the brush hole 11 by operation of the above-mentioned retractable ejecting mechanism.

To realize the retractable ejecting mechanism of the cartridge 200, the cartridge 200 has the locking protrusion 201 on the sidewall thereof, with the guide protrusion 202 integrally formed on the sidewall of the cartridge 200.

The locking protrusion 201 is an elastic member, which is formed on the sidewall of the sealed filter receiving part 243 such that the locking protrusion 201 can be caught by the first locking hole 103 or by the second locking hole 104 of the barrel 100 during the reciprocating motion of the cartridge 200 inside the barrel 100.

The locking protrusion 201 is a protrusion formed in a curved plate 204 on the free end. The curved plate 204 is seated in a recess 203, which is formed in the side surface of the filter receiving part 243 to a predetermined depth, such that a predetermined space can be defined between the recess 203 and the curved plate 204. To define the space between the recess 203 and the curved plate 204, the curved plate 204 has a predetermined thickness not exceeding the depth of the recess 203.

To define the predetermined space between the curved plate 204 having the locking protrusion 201 and the recess 203 of the filter receiving part 243, either the recess 203 or the curved plate 204 has opposite supports (not shown). When the curved plate 204 is seated in the recess 203, a parallel space can be defined between the locking protrusion 201 and the recess 203 by the supports.

Further, the curved plate 204 having the locking protrusion 201 has thickness smaller than the depth of the recess 203 and is seated in the recess 203 with the parallel space defined between them. Further, the curved plate 204 having the locking protrusion 201 is seated in the recess 203 such that there is no step between them, thus giving the filter receiving part 243 a continuous and smooth outer surface without having any step.

Due to the space defined between the locking protrusion 201 and the recess 203, when the free end of the locking protrusion 201 is pushed inwards in a radial direction of the filter receiving part, the locking protrusion 201 can be bent inwards in the radial direction.

In other words, in the same manner as that described for the return switch 102, the locking protrusion 201 can be elastically bent inwards into the outer circumferential surface of the filter receiving part 243. Particularly, when the return switch 102 pushes the locking protrusion 201 which has been caught by the first locking hole 103, the locking protrusion 201 can be bent inwards into the outer circumferential surface of the filter receiving part 243 and can be removed from the first locking hole 103.

Further, the guide protrusion 202 is formed on the outer circumferential surface of the cartridge at a location diametrically opposite to the locking protrusion 201 and movably engages with the guide slot 105, so that, when the cartridge 200 rectilinearly reciprocates inside the barrel 100, the guide protrusion 202 can guide the movement of the cartridge while being guided by the guide slot 105 of the barrel.

Further, the filter receiving part 243 is provided with an axial recess on the sidewall thereof at a location corresponding to both the guide protrusion and the locking protrusion, thus defining a space allowing the free ends of both the guide protrusion and the locking protrusion to be efficiently bent inwards in the filter receiving part 243.

Further, in the rear end of the cartridge 200, both a cone insert hole 242 and a cone holding part 208 having diameters smaller than that of the filter receiving part 243 are formed, so that a brush holding cone can be installed in the cone holding part 208 by being seated in a step of the cone insert hole 242.

Here, it is preferred that the cone holding part 208 and the filter receiving part 243 have the same inner diameter.

The cone holding part 208 has external threads and tightened to internal threads of the cap as will be described later herein.

The inner surface of the connection part 244 is provided with a plurality of axial ribs 207, which are formed around the inner surface and are spaced apart from each other at regular angular intervals, so that a filter 80 can be stably held in the connection part 244 as will be described later herein.

As shown in FIG. 8, the cap 40 has a conical shape and is tightened to the cone holding part 208 at an opening 42, thus covering the cone holding part 208.

To realize the engagement between the cap 40 and the cone holding part 208, the cap 40 has internal threads 41 in the opening 42 and is tightened to external threads formed on the cone holding part 208.

Here, it is preferred that the outer diameter of the cap 40 be the same as the outer diameter of the filter receiving part 243.

The cone 30 shown in FIG. 3 holds the second brush 20 and is held in the cone holding part 208, and comprises an insert part 31 having an outer diameter corresponding to the inner diameter of the cone holding part 208, and a brush holding part 32 having an outer diameter equal to the outer diameter of the cone holding part 208 and holding to the cone holding part 208 therein.

Here, the end of the insert part 31 is a hollow end so that, when it comes into contact with the filter 80 installed in the cartridge 200, the disinfectant of the filter 80 can be supplied to the second brush 20 through the open end of the insert part 1.

The brushes may use typical makeup brushes made of animal hair or synthetic resin, and is securely mounted both to the brush holding part and the cone and can be disinfected by the disinfectant of the filter.

FIGS. 9A, 9B, 10A, 10B and 11 show the makeup brush tool of the present invention in a closed state in which the first brush is fully retracted into the barrel and sealed by the openable door module 90.

As shown in FIGS. 9A, 9B, 10A and 10B, the first brush is held by the brush holding part 246 of the cartridge 200 and the cone 30 having the second brush 20 is held by the cone holding part 208.

Further, the filter 80 charged with a volatile disinfectant is installed in the cartridge 200 and the cartridge 200 is inserted into the barrel 100.

In the above state, the locking protrusion 201 of the cartridge 200 is caught by the second locking hole 104 of the barrel 100, so that the cartridge 200 is not moved. However, the cartridge 200 in the above state is elastically biased backwards by the spring 50 of the anti-drying unit which is in contact with the brush hole 11 of the barrel 100, so that the cartridge 200 is tensioned.

The rear end of the spring 50 is stopped by the annular step formed between the filter receiving part 243 and the connection part 244 of the cartridge 200 and the front end of the spring 50 is stopped by the O-ring 60.

The O-ring 60 is forcibly fitted into the barrel 100 and comes into contact with the spring 50 and the packing 70 on opposite surfaces thereof.

The packing 70 is closely interposed between the openable door module 90 and the extension part 245, thus air-tightly packing the gap between them.

The front end of the openable door module 90 is in close contact with the brush hole 11 and the rear end of the module 90 is in close contact with the packing 70, so that the front end of the module 90 is fixed, but only the rear end of the module 90 can be moved along with the packing 70 so as to open or close the ball-type door during reciprocating movement of the cartridge 200 inside the barrel 100.

Further, as shown in FIG. 11, when the cap 40 is opened, both the second brush 20 and the brush holding part 32 of the cone 30 are exposed to the atmosphere. To cover the second brush and thereby to protect the second brush from the atmosphere, the cap 40 is tightened to the cone holding part 208 by tightening the internal threads of the cap 40 to the external threads of the cone holding part 208.

When the end of the cap 40 is pressed by the user with the thumb, both the cap 40 and the cone 30 holding the second brush are moved forwards along with the cartridge 200 and the locking protrusion 201 of the cartridge 200 is removed from the second locking hole 104 of the barrel 100, as shown in FIGS. 12A, 12B, 13A and 13B.

When the pushing pressure is further applied to the cap 40, the cartridge 200 axially moves forwards in the barrel 100 under the guide of the guide protrusion 202 movably engaging in the guide slot 105 of the barrel 100 until the locking protrusion 201 is caught by the first locking hole 103.

When the cartridge 200 moves forwards in the barrel 100 as described above, the spring 50 of the anti-press unit is compressed by the forward movement of the cartridge 200. Further, the ball-type door of the openable door module 90 opens the brush hole 11 and the first brush 10 mounted to the front end of the cartridge 200 can be ejected to the atmosphere through the open brush hole 11.

When the user presses the return switch 102, the free end of the locking protrusion 201 which has been caught by the first locking hole 103 is bent inwards and is removed from the first locking hole 103, so that the cartridge 200 can be elastically pushed backwards by the restoring force of the spring 50 the guide protrusion 202. Thus, the cartridge 200 axially moves backwards in the barrel 100 under the guide of the guide protrusion 202 movably engaging with the guide slot 105. When the locking protrusion 201 is caught by the second locking hole 104, the retraction of the cartridge 200 is stopped.

During the retraction of the cartridge 200, the rear end of the openable door module 90 of the anti-drying unit is moved backwards along with the cartridge 200, so that the ball-type door of the openable door module 90 closes the brush hole 11 while the first brush 10 returns to the original position inside the barrel 100, as shown in FIGS. 9A, 9B, 10A and 10B. The first brush 10 in the above state can be air-tightly kept in the sealed barrel 100.

When the cartridge 200 moves forwards in the barrel 100 as described above, the spring 50 of the anti-drying unit is compressed by the forward movement of the cartridge 200. Further, the ball-type door of the openable door module 90 opens the brush hole 11 and the first brush 10 mounted to the front end of the cartridge 200 can be ejected to the atmosphere through the open brush hole 11.

What is claimed is:

1. A double-ended makeup brush tool having an automatic sealing structure comprising:

a barrel shaped in a form of an integrated tubular casing, with a brush hole formed through a conical front end of the barrel so as to allow a retractable ejection of a first brush therethrough, and with an insert hole formed through a rear end of the barrel;

a cartridge sealed at opposite ends thereof both by the first brush attached to a front end and by a second brush attached to a rear end, the cartridge being inserted into the barrel such that the cartridge can be axially moved forwards and backwards inside the barrel; and an anti-drying unit interposed between the cartridge and the barrel such that the anti-drying unit can air-tightly seal the brush hole of the barrel in response to axial movement of the cartridge;

wherein the barrel is provided with a first locking hole and a second locking hole sequentially formed in the barrel at respective locations spaced apart from each other in an axial direction from the rear end of the barrel, and the cartridge is provided with a locking protrusion protruding from a sidewall of a filter receiving part defined in the rear end of the cartridge such that the locking protrusion can be removably caught by the first locking hole or by the second locking hole.

2. The double-ended makeup brush tool as set forth in claim 1, wherein the locking protrusion is formed on a sidewall of the cartridge in the form of an elastic free end such that the locking protrusion can be easily and removably caught by the first locking hole or by the second locking hole.

3. The double-ended makeup brush tool as set forth in claim 2, wherein the locking protrusion is formed in a curved plate, which is seated in a recess formed in a sidewall of the sealed filter receiving part to a predetermined depth and has a shape corresponding to the recess, wherein either the curved plate or the recess has a pair of supports such that the curved plate can be seated in the recess while defining a parallel space between them and allowing outer surfaces of the curved plate and the filter receiving part to make contact with each other without a step being formed between them.

4. The double-ended makeup brush tool as set forth in claim 2, wherein the barrel further comprises: a return switch formed on the barrel in a form of a free end at a location in front of the first locking hole and allowing the locking protrusion to be easily removed from the first locking hole, so that, when the return switch is pressed, the return switch is bent into the barrel and renders the locking protrusion, which was caught in the first locking hole, to be bent into the cartridge and thereby to be displaced from the first locking hole.

5. The double-ended makeup brush tool as set forth in claim 4, wherein the cartridge is provided with a recess for defining a space allowing the free end of the locking protrusion to be bent into the space.

6. The double-ended makeup brush tool as set forth in claim 4, wherein the return switch has a protruding push part so that the return switch can be easily pushed.

7. The double-ended makeup brush tool as set forth in claim 1, wherein the cartridge is provided with a free end-shaped guide protrusion at a location opposite the locking protrusion, and the barrel is provided with a guide slot at a location corresponding to the guide protrusion for receiving the guide protrusion therein, thus guiding rectilinear movement of the guide protrusion as the cartridge moves axially inside the barrel.

8. The double-ended makeup brush tool as set forth in claim 7, wherein the cartridge is provided with a recess for defining a space allowing the free end of the locking protrusion to be bent into the space.

9. A double-ended makeup brush tool having an automatic sealing structure comprising:

a barrel shaped in a form of an integrated tubular casing, with a brush hole formed through a conical front end of the barrel so as to allow a retractable ejection of a first brush therethrough, and with an insert hole formed through a rear end of the barrel;

a cartridge sealed at opposite ends thereof both by the first brush attached to a front end and by a second brush attached to a rear end, the cartridge being inserted into the barrel such that the cartridge can be axially moved forwards and backwards inside the barrel; and an anti-drying unit interposed between the cartridge and the barrel such that the anti-drying unit can air-tightly seal the brush hole of the barrel in response to axial movement of the cartridge; wherein the cartridge comprises:

a filter receiving part for receiving a filter therein, the filter receiving part having a predetermined diameter, with a locking protrusion formed in the filter receiving part at a location near a rear end of the filter receiving part;

a cone holding part extending from the rear end of the filter receiving part and having a diameter smaller than that of the filter receiving part, and holding the second brush therein;

a connection part extending from a front end of the filter receiving part and having a diameter smaller than that of the filter receiving part, and receiving an extension part of the filter received in the filter receiving part;

an extension part extending from the connection part and having a diameter smaller than that of the connection part, and holding the first brush in a front end thereof; and a brush holding part provided in the front end of the extension part and securely holding the first brush.

10. The double-ended makeup brush tool as set forth in claim 9, wherein the cartridge further comprises:

a hollow cone received in the cone holding part, with the second brush held in the hollow cone in such a way that a disinfectant impregnated in the filter received in the filter receiving part can be supplied to the second brush.

11. The double-ended makeup brush tool as set forth in claim 9, further comprising:

a conical cap for covering the second brush, the conical cap having internal threads engaging with external threads of the cone holding part.

* * * * *